US010188251B2

(12) United States Patent
Nortrup et al.

(10) Patent No.: US 10,188,251 B2
(45) Date of Patent: Jan. 29, 2019

(54) SURFACE MAINTENANCE VEHICLE WITH AN INTEGRATED WATER TRAP FOR TRAPPING RESIDUAL WASTE

(71) Applicant: Tennant Company, Minneapolis, MN (US)

(72) Inventors: Eric S. Nortrup, Minneapolis, MN (US); Nicholas E. Boers, West Olive, MI (US); Brent Caudill, Holland, MI (US)

(73) Assignee: Tennant Company, Minneapolis, MN (US)

( * ) Notice: Subject to any disclaimer, the term of this patent is extended or adjusted under 35 U.S.C. 154(b) by 226 days.

(21) Appl. No.: 14/885,152

(22) Filed: Oct. 16, 2015

(65) Prior Publication Data

US 2016/0120385 A1 May 5, 2016

Related U.S. Application Data

(60) Provisional application No. 62/074,375, filed on Nov. 3, 2014.

(51) Int. Cl.
*A47L 11/30* (2006.01)
*A47L 11/40* (2006.01)

(52) U.S. Cl.
CPC ..... *A47L 11/30* (2013.01); *A47L 11/4016* (2013.01); *A47L 11/4036* (2013.01);
(Continued)

(58) Field of Classification Search
CPC .. A47L 11/30; A47L 11/4016; A47L 11/4036; A47L 11/4044; A47L 11/4072; A47L 11/4077
See application file for complete search history.

(56) References Cited

U.S. PATENT DOCUMENTS 1,042,711 A 10/1912 Moorhead
2,822,061 A * 2/1958 Pettit ..... A47L 7/0009 15/321

(Continued)

FOREIGN PATENT DOCUMENTS

EP 1929913 A1 6/2008
JP G05084212 A 4/1993

OTHER PUBLICATIONS

Minuteman International, Inc., Minuteman ES 260/320, "Walk-Behind Automatic Scrubber," www.minutemanintl.com; 4 pages, Oct. 21, 2013.

(Continued)

*Primary Examiner* — Robert J Scruggs
(74) *Attorney, Agent, or Firm* — Fredrikson & Byron, P.A.

(57) ABSTRACT

Embodiments include a waste recovery system for a floor surface maintenance machine. The waste recovery system comprises a squeegee assembly having a squeegee frame, a squeegee retainer extending below the squeegee frame and a reservoir integrally defined in the squeegee retainer. The reservoir can have an inlet passage proximal to the floor surface, an outlet passage fluidly coupled to the fluid suction path and leading to the waste recovery tank, and a fluid trap portion positioned between the inlet and outlet passages. The fluid trap portion can retain backflow waste in the fluid suction path. The reservoir is positioned at a clearance distance from the floor surface in a direction normal to the floor surface such that the reservoir forms the lowest portion of the waste recovery system in the direction normal to the floor surface.

21 Claims, 8 Drawing Sheets

(52) U.S. Cl.
CPC ..... *A47L 11/4044* (2013.01); *A47L 11/4072* (2013.01); *A47L 11/4077* (2013.01)

(56) References Cited

U.S. PATENT DOCUMENTS

| | | | | |
|---|---|---|---|---|
| 3,477,088 | A | 11/1969 | Eggert | |
| 4,571,771 | A | 2/1986 | Worwa | |
| 5,802,665 | A * | 9/1998 | Knowlton | A47L 11/24 15/340.1 |
| 5,901,407 | A | 5/1999 | Boomgaarden | |
| 6,047,437 | A * | 4/2000 | Suzuki | A47L 11/305 15/245 |
| 2002/0184729 | A1 | 12/2002 | Farina | |
| 2003/0208873 | A1 | 11/2003 | Chang | |
| 2008/0127445 | A1* | 6/2008 | Konandreas | A22C 17/0013 15/319 |
| 2014/0366317 | A1 | 12/2014 | Wydra | |

OTHER PUBLICATIONS

International Search Report and Written Opinion for PCT/US2015/055922, dated Jan. 11, 2016, 11 pages.
BETCO Stealth ASD2OBT, Operator and Parts Manual, 20" Automatic Scrubber with the Traction Drive, Oct. 2011, 52 pages.

* cited by examiner

SURFACE MAINTENANCE VEHICLE WITH AN INTEGRATED WATER TRAP FOR TRAPPING RESIDUAL WASTE

CROSS REFERENCE TO RELATED APPLICATION

This application claims the benefit of U.S. Provisional Application No. 62/074,375, filed Nov. 3, 2014, entitled "SURFACE MAINTENANCE VEHICLE WITH AN INTEGRATED WATER TRAP FOR TRAPPING RESIDUAL WASTE."

FIELD OF THE INVENTION

The present disclosure generally relates to waste recovery systems of surface cleaning machines having a reservoir for trapping residual waste.

BACKGROUND OF THE INVENTION

Floor cleaning in public, commercial, institutional and industrial buildings have led to the development of various specialized floor cleaning machines, such as hard and soft floor cleaning machines. These cleaning machines generally utilize a cleaning head that includes one or more cleaning tools configured to perform the desired cleaning operation on the floor surface. These cleaning machines include dedicated floor sweeping machines, dedicated floor scrubbing machines and combination floor sweeping and scrubbing machines.

An example of a dedicated hard floor sweeping and scrubbing machine is described in U.S. Pat. No. 5,901,407, which is assigned to Tennant Company of Minneapolis, Minn. and which is hereby incorporated by reference in its entirety. The machine uses a cleaning head having two cleaning tools in the form of cylindrical brushes. The cleaning tools counter-rotate in the directions indicated by the arrows shown. Water, detergent and/or cleaning solution are sprayed on the floor ahead of the brushes so the brushes can scour the floor at the same time they are sweeping debris from the floor. A vacuum squeegee removes fluid waste from the floor during the wet scrubbing and sweeping operations. The cleaning tools engage each other such that debris on the floor is swept between the two cleaning tools and is directed into a waste hopper by a deflector.

An example of a dedicated floor sweeper is described in U.S. Pat. No. 4,571,771, which is assigned to Tennant Company of Minneapolis, Minn. and is hereby incorporated by reference in its entirety. The floor sweeper includes a cleaning head comprised of a rotating cylindrical brush that contacts the floor and throws loose debris into a hopper which is periodically emptied either manually or through a motorized lift. Combination floor sweeping and scrubbing machines were developed to avoid the necessity of having two machines. Some floor sweeping and scrubbing machines were created by mounting sweeping components to the front end of a dedicated scrubbing machine to making one large, multi-function machine.

When a surface maintenance machine performs wet scrubbing operation, water, detergent and/or cleaning solution from a solution tank are sprayed or poured on the floor through a solution valve to the brushes. As the surface maintenance machine moves forward, a squeegee wipes the waste water off the floor, and a vacuum system applies suction to remove the waste water from the floor upwards through a recovery hose and into a recovery tank. When the vacuum supply is turned off, any waste water still present in the recovery hose flows down to the floor due to lack of suction. This is referred to as hose runoff. Hose runoff is typically prevented by tying a knot or including a loop in the recovery hose.

SUMMARY

Certain embodiments of the invention include a waste recovery system for a floor surface maintenance machine connected to a vacuum system adapted to start and stop suctioning waste from a floor surface. The waste recovery system comprises a fluid suction path extending from the floor surface to a waste recovery tank, the fluid suction path operably coupled to the vacuum system such that the vacuum system draws waste from the floor surface through the fluid suction path by applying a suction force.

The waste recovery system comprises a squeegee assembly, with a squeegee frame, comprising a front wall and a rear wall, the rear wall being to the rear of a transverse centerline of the squeegee frame when the floor surface maintenance machine is operated in a forward direction. The squeegee assembly comprises a squeegee retainer extending below the squeegee frame. The squeegee retainer having a reservoir integrally defined therein. An inlet passage is positioned proximal to the rear wall of the squeegee frame and an outlet passage is fluidly coupled to the fluid suction path and leading to the waste recovery tank.

The waste recovery system comprises a fluid trap portion positioned between the inlet and outlet passages, the fluid trap portion adapted to retain backflow waste in the fluid suction path. A first squeegee connectable to the squeegee retainer and adapted to treat the floor surface and direct waste thereon towards the vacuum system, the first squeegee being positioned proximal to the rear wall of the squeegee frame.

In certain embodiments, the squeegee assembly is configured such that the reservoir is positioned at a clearance distance from the floor surface in a direction normal to the floor surface such that the reservoir forms the lowest portion of the waste recovery system in the direction normal to the floor surface.

Certain embodiments include a floor surface maintenance machine, comprising a machine frame adapted to support wheels and a scrub head, a vacuum system supported by the machine frame, the vacuum system adapted to apply a suction force on waste on a floor surface and a waste recovery system fluidly coupled to the vacuum system, wherein the waste recovery system is according to any of the embodiments described herein.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1A:
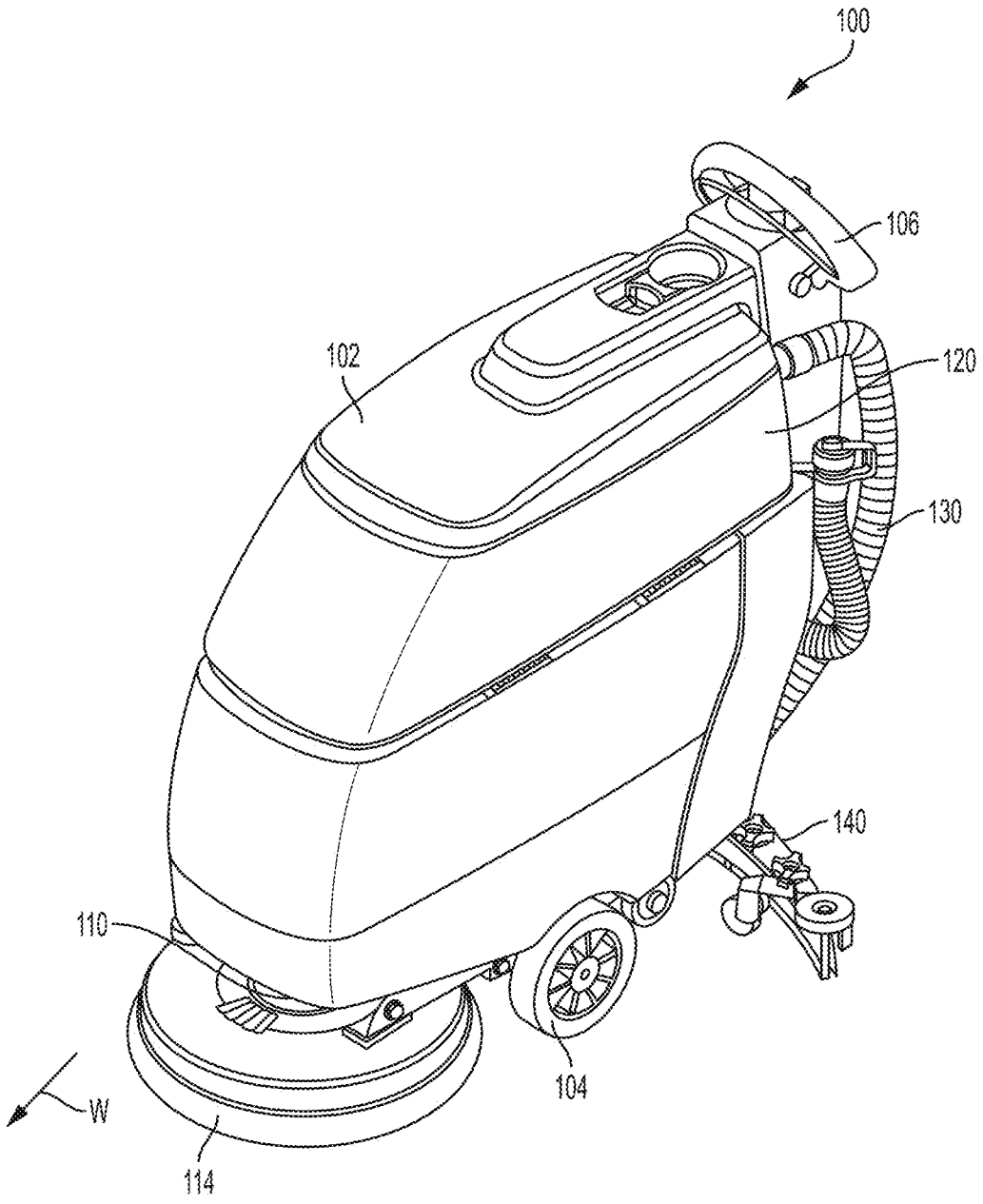
FIG. 1A is a front perspective view of an exemplary floor surface maintenance machine employing an embodiment of the self-cleaning reservoir of the present invention.
Figure 1B:
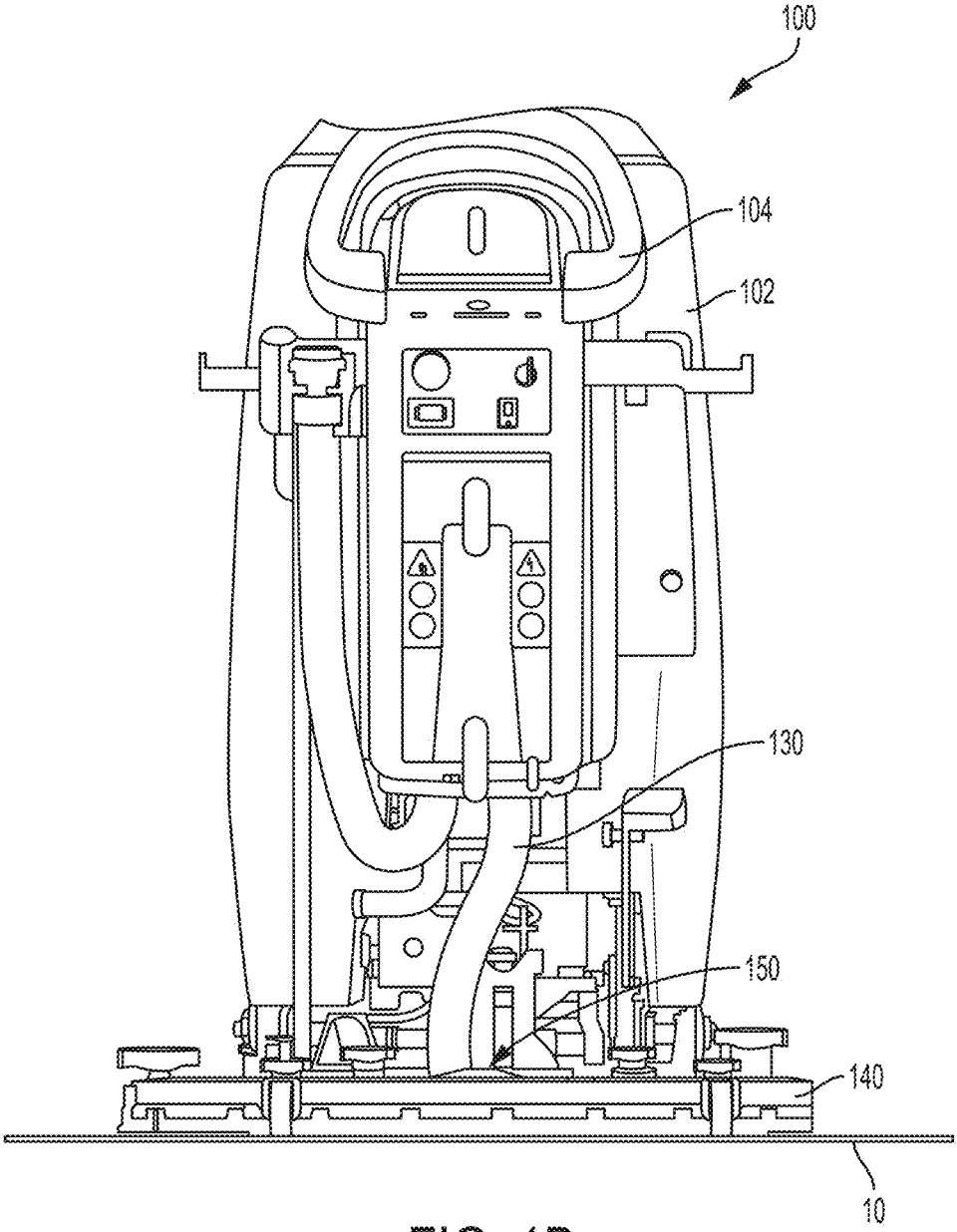
FIG. 1B is a rear elevation view of the floor surface maintenance machine of FIG. 1A.

FIGS. 1A and 1B illustrate an exemplary floor surface cleaning machine 100 operating on a floor surface 10. Embodiments of the machine 100 include components that are supported on a motorized mobile body. The mobile body 102 comprises a frame supported on wheels 104 for travel over a surface, on which a cleaning operation is to be performed. The mobile body 102 includes operator controls (not shown) and a steering wheel 106. The machine 100 can be a ride-on machine and can include a seat so that a seated operator of machine 100 may steer the machine 100. Machine 100 is preferably powered by one or more batteries that may be contained in a compartment beneath the seat. Alternately, the power source may be an internal combustion engine, powered through an electrical source (e.g., via a wall outlet through a cord), or one or more power cells.

Cleaning components extend from an underside of the machine 100. For example, a scrub head can be located at a middle portion of machine 100. The scrub head 110 has a housing that encloses one or more brushes 114. The brushes 114 are driven by one or more electric motors. An electric actuator attached between the scrub head 110 and the housing raises the scrub head 110 for transport, lowers it for work, and controls its down pressure on the floor. While FIG. 1A shows the scrub head 110 having one disk-shaped scrub brush 114, the scrub head 110 can alternatively use two disk scrub brushes rotating about parallel vertical axes. Alternatively, scrub head 110 may have with any number of disk scrub brushes or pads, or one or more cylindrical brushes rotating about horizontal axes. While a scrub head 110 is depicted in the figures, any appliance or tool for providing surface maintenance, surface conditioning, and/or surface cleaning to a surface may be coupled to an associated machine or vehicle in accordance with the present invention. Machine 100 may also include a side brush assembly for cleaning a larger floor envelope. Such side brush assemblies make it easier to clean near walls or other obstacles without damaging the machine or the wall while at the same time widening the cleaning path of the machine to increase productivity.

During wet scrubbing operations, water or a cleaning fluid contained in a tank is sprayed to or poured on the surface beneath machine 100, in proximity to the scrub head 110. Brushes (not shown) scrub the surface and the soiled cleaning fluid and/or debris (collectively referred to herein as "waste") is then collected by a waste recovery system 150 and deposited in a waste recovery tank 120. In some embodiments the machine 100 includes a vacuum system mounted to the machine 100. The vacuum system also includes a vacuum port (not shown) that is placed in fluid communication with a vacuum fan (not shown). The vacuum fan operates to remove fluid and particle waste to store it in the waste recovery tank 120.

The floor surface maintenance machine 100 may comprise a vacuum system having a vacuum port (not shown) placed in communication with a vacuum fan (not shown). When the vacuum fan is operational, it creates suction inside a recovery hose 130, collecting fluid and particle debris from the surface and directing it to the waste recovery tank 120. In some cases, the debris and waste collected from the floor surface 10 by the suction force generated by the vacuum system can be directed to a waste recovery tank 120.

In alternate embodiments, the floor surface maintenance machines 100 may be combination sweeper and scrubber machines. In such embodiments, in addition to the elements describe above, the machine 100 may also include sweeping brushes and a hopper extending from the underside of the machine 100, with the sweeping brushes designed to direct dirt and debris into the hopper. In such cases, solid waste (e.g., dirt and debris) can be directed from the floor surface 10 into the waste recovery tank 120. Alternatively, the machine 100 may be designed for use by an operator that walks behind the machine, or the machine may be configured to be towed behind a vehicle. As used herein, the term "waste" refers to solid and liquid waste, and may include soiled and/or clean fluids, dirt and debris.

Figure 2:
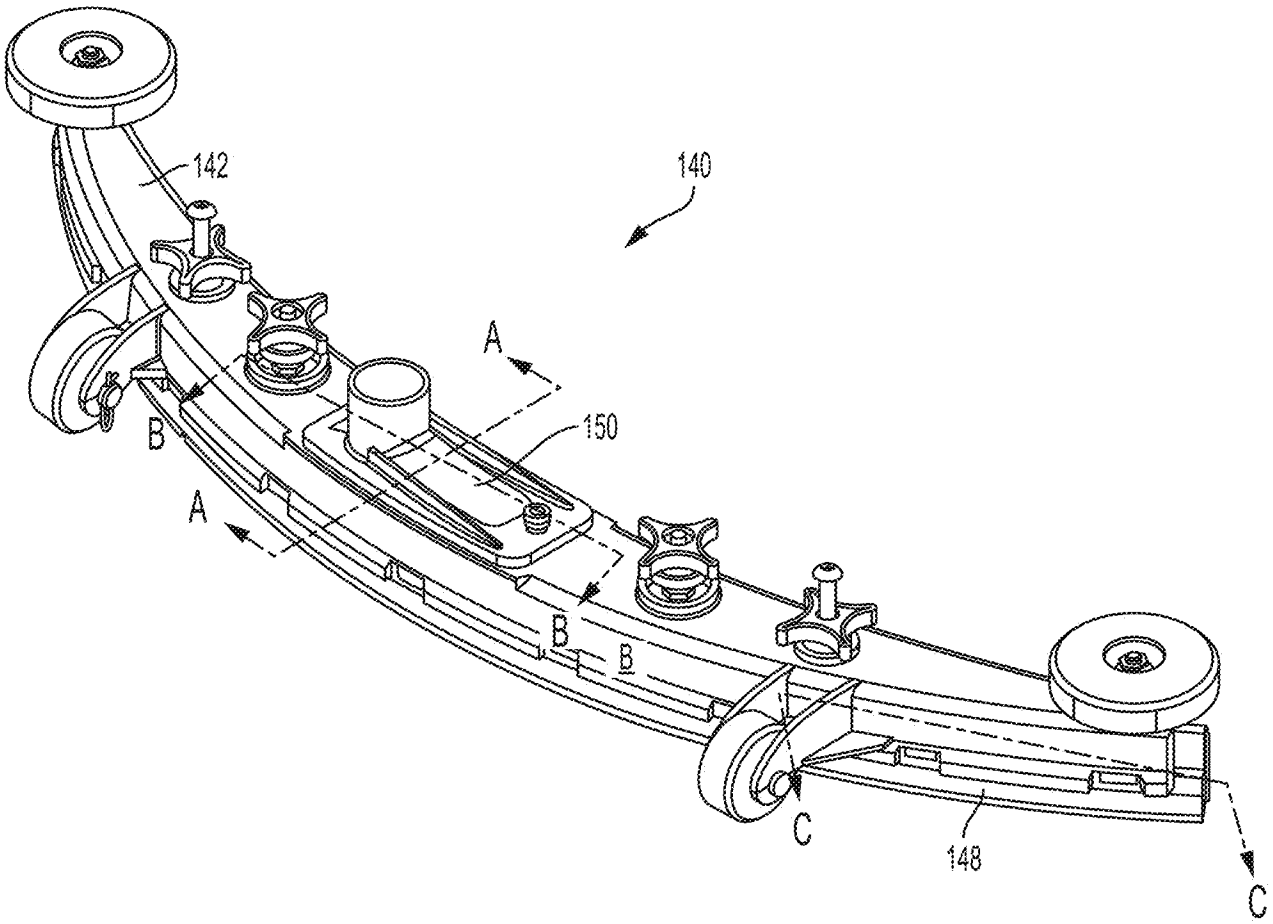
FIG. 2 is a perspective view of a squeegee assembly with a portion of a waste recovery system according to an embodiment of the invention.
Figure 3:
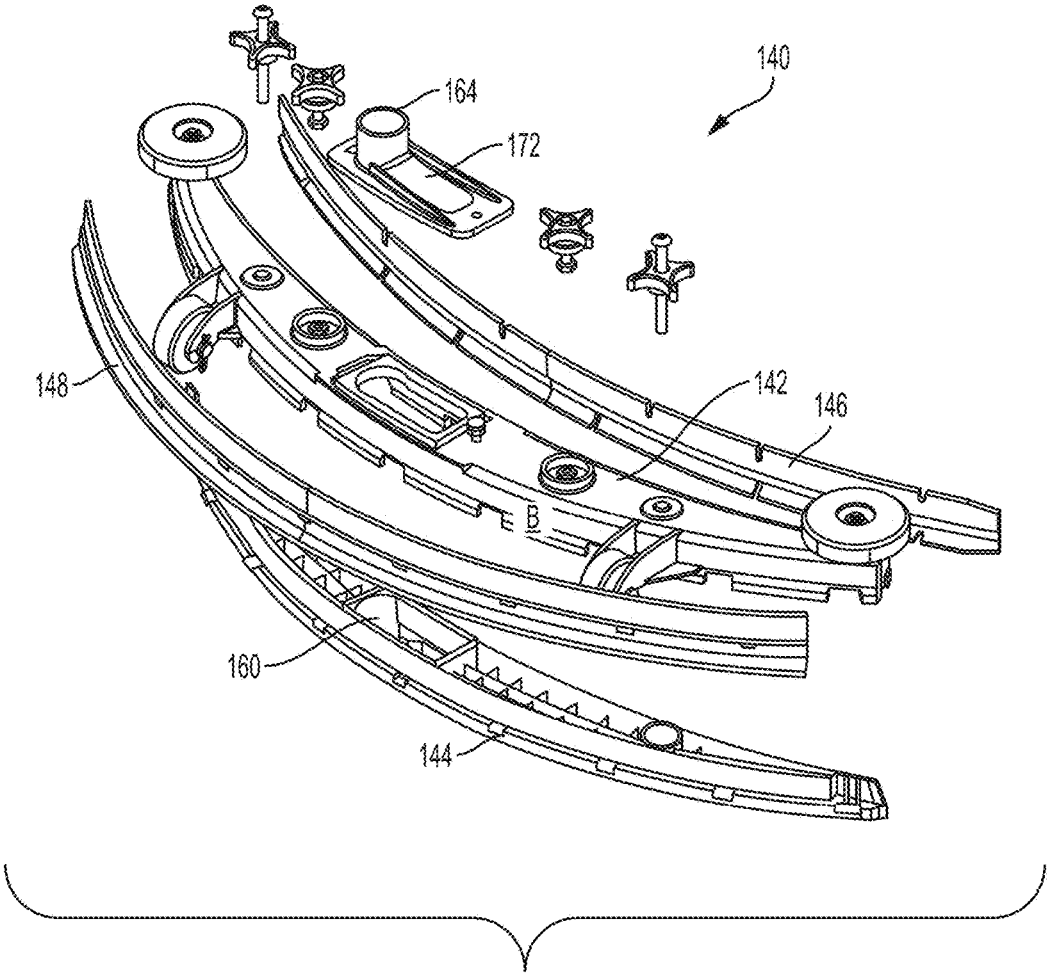
FIG. 3 is an exploded perspective view of the squeegee assembly of FIG. 2.

FIG. 2 is an upper perspective view of a squeegee assembly 140 showing a portion of the waste recovery system 150. FIGS. 2 and 3 show various portions of the waste recovery system 150. The waste recovery system 150 can be in fluid communication with the vacuum system. The waste recovery system 150 can be coupled to the recovery hose 130 by a friction fit. Alternatively, the recovery hose 130 can be connected to the waste recovery system 150 by hose clamps, fasteners, flanges or other means of fluid couplings. The waste recovery system 150 can trap residual waste and particle waste trapped in the waste recovery system 150 when the vacuum system stops suctioning waste from a floor surface.

Figure 4:
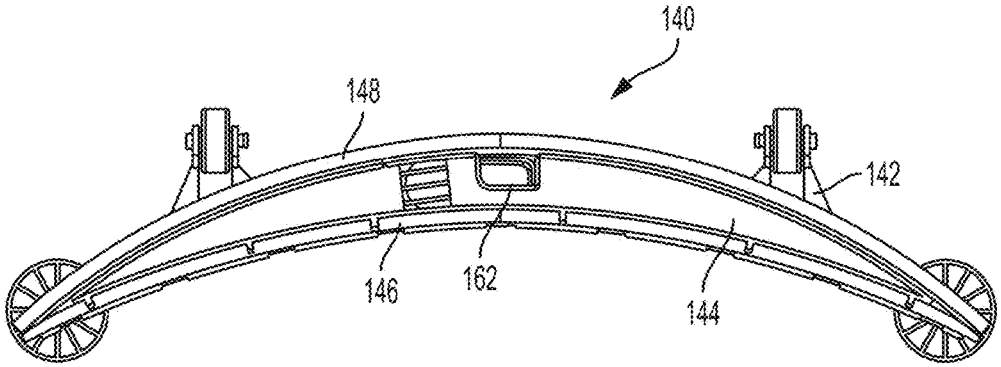
FIG. 4 is a bottom elevation view of the squeegee assembly of FIG. 2.

Referring back to FIG. 4 the waste recovery system 150 comprises a fluid suction path 152 extending from a squeegee assembly 140 to a waste recovery tank 120 (best shown in FIG. 1). The fluid suction path 152 is in communication with (e.g., connected to) the vacuum system such that the vacuum system draws waste from the floor surface through the fluid suction path 152 by applying a suction force. The squeegee assembly 140 has a squeegee frame 142, a squeegee retainer 144 extending below the squeegee frame 142, and at least one squeegee 146 connectable to the squeegee retainer 144. In the embodiments illustrated in FIGS. 4 and 5, the squeegee assembly 140 has two squeegees: a front squeegee 146 proximal to the front wall "A" of the squeegee frame 142 and a rear squeegee 148 proximal to the rear wall "B" of the squeegee frame 142. The squeegees 146, 148 are supported on the squeegee frame 142 and connected thereto by one or more fasteners (e.g., screws, clips, teeth) shown in FIGS. 5 and 6. The squeegees (146, 148) can be shaped to direct waste toward the vacuum port, so as to facilitate the suction forces to draw waste and debris from the floor surface 10. As shown in FIG. 4, the squeegee (146, 148) can be generally curved. The radius of curvature can be chosen to provide a sufficient funneling of waste and other particle waste from the floor surface 10 to the recovery hose 130.

Figure 5:
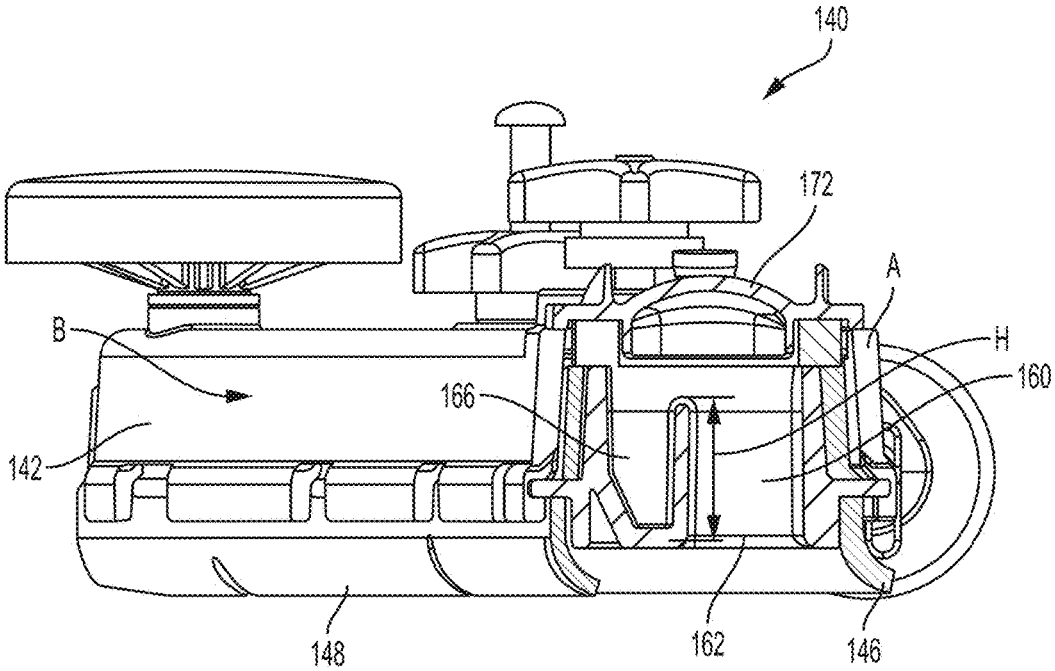
FIG. 5 is a sectional side view of the squeegee assembly of FIG. 2 taken along the sectional plane A-A.

With continued reference to FIG. 5, the squeegee retainer 144 can have a reservoir 160 integrally defined therein. The reservoir 160 can trap waste and particle waste that are still present in the waste recovery system 150 when the vacuum system stops suctioning waste from the floor (e.g., when an operator switches off the vacuum system, etc.). As seen in FIG. 5, the reservoir 160 comprises an inlet passage 162. While not illustrated, the inlet passage 162 can be in fluid communication with a vacuum port and draw waste from the floor and into the waste recovery system 150. The inlet passage 162 can be shaped such that waste and particle waste are drawn into the waste recovery system 150 with a uniform air velocity. For instance, the inlet passage 162 can have a uniform cross-section. Additionally, the inlet passage 162 can have rounded edges or contoured so as to draw waste uniformly. In some cases, the inlet passage 162 extends for an inlet passage height "H". The inlet passage height "H" can be configured to hold a desired volume of fluid, while maintaining a desired flow velocity at the inlet. In some cases, waste and waste may collect toward the rear squeegee 148 when the machine is moving a forward direction (e.g., along arrow "W" seen in FIG. 1A). In such cases, the inlet passage 162 can be positioned proximal to the rear squeegee 148 (i.e., offset from a transverse centerline of the squeegee "T" shown in FIG. 5) so that the vacuum system can draw the collected waste and waste from near the rear squeegee blade 148. Other positions and orientation of the inlet passage 162 is also contemplated.

Figure 6:
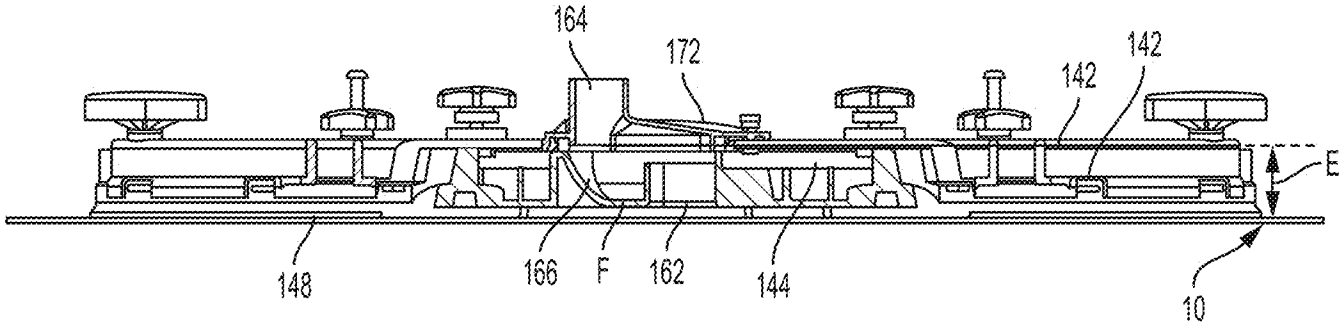
FIG. 6 is a sectional front view of the squeegee assembly of FIG. 2 taken along the sectional plane B-B.

As seen in FIG. 6, the reservoir 160 has an outlet passage 164 fluidly coupled to the fluid suction path 152 and leading to the waste recovery tank 120 (best seen in FIG. 1). Referring back to FIGS. 5 and 6, the outlet passage 164 can form a frictional fit with the recovery hose 130. Alternatively, the recovery hose 130 can be connected by fasteners, clamps, threaded connections, or other fluid coupling means known in the art. Waste and particle waste can be drawn from the floor into the inlet passage 162 and directed to the outlet passage 164 when the vacuum system is suctioning waste and particle waste from the floor surface.

With continued reference to FIG. 6, the reservoir 160 comprises a fluid trap portion 166 positioned between the inlet and outlet passages 162, 164. The fluid trap portion 166 is formed by a wall "C" of the fluid trap portion 166 and a wall "D" of the inlet passage 162. The fluid trap portion 166 is of a shape configured for holding a desired volume of trapped waste and particle waste. The fluid trap portion 166 can retain backflow waste in the fluid suction path 152. The squeegee assembly 140 is configured such that the reservoir 160 is positioned at a clearance distance "E" from the floor surface 10 in a direction normal to the floor surface 10 such that the reservoir 160 forms the lowest portion of the waste recovery system 150 in the direction normal to the floor surface 10. In other words, the distance "E" between the reservoir 160 and the floor surface 10 is less than a distance between any other component of the waste recovery system 150 and the floor surface. As the fluid trap portion 166 forms the lowest point on the waste recovery system 150, any waste or particle waste remaining thereabove can fall into the fluid trap portion 166. With no other component to hold any residual waste or waste below the fluid trap portion 166, the waste recovery system 150 of the illustrated embodiment can effectively contain residual waste and waste after the vacuum system is disengaged or the machine is switched off.

Figure 7A:
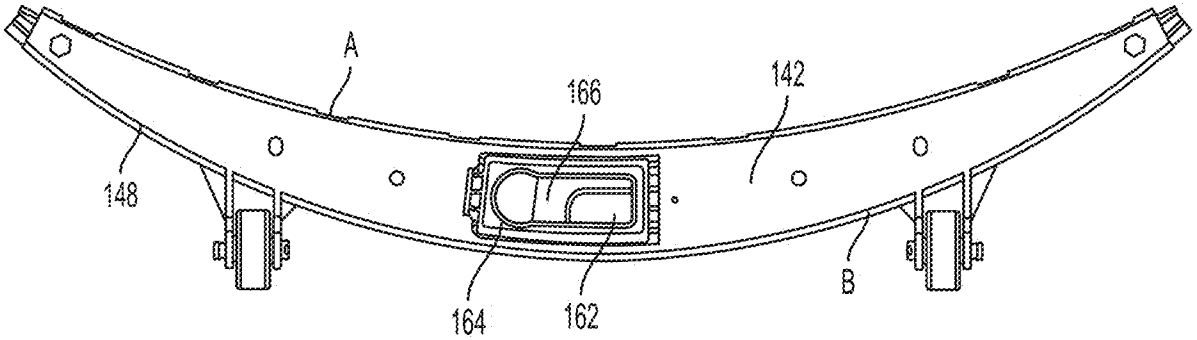
FIG. 7A is a sectional plan view of the squeegee assembly of FIG. 2 taken along the sectional plane C-C.
Figure 7B:
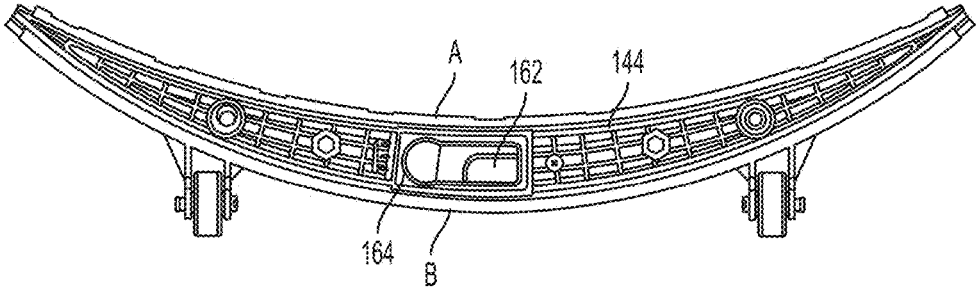
FIG. 7B is a sectional plan view of the squeegee assembly of FIG. 2 taken along the sectional plane C-C.

In some cases best illustrated in FIG. 6, when the machine is placed on a flat floor surface, the fluid trap portion 166 is the lowest vertical point "F" on the squeegee assembly 140. The fluid trap portion 166 can retain waste and particle waste in the walls of the outlet passage 164 or the recovery hose 130 when the vacuum system is switched off by an operator. In some cases as seen in FIGS. 6 and 7A, the fluid trap portion 166 can be inline with the outlet passage 164 to effectively contain residual waste present in the waste recovery system 150 when the vacuum system stops suctioning waste from the floor surface.

Figure 9:
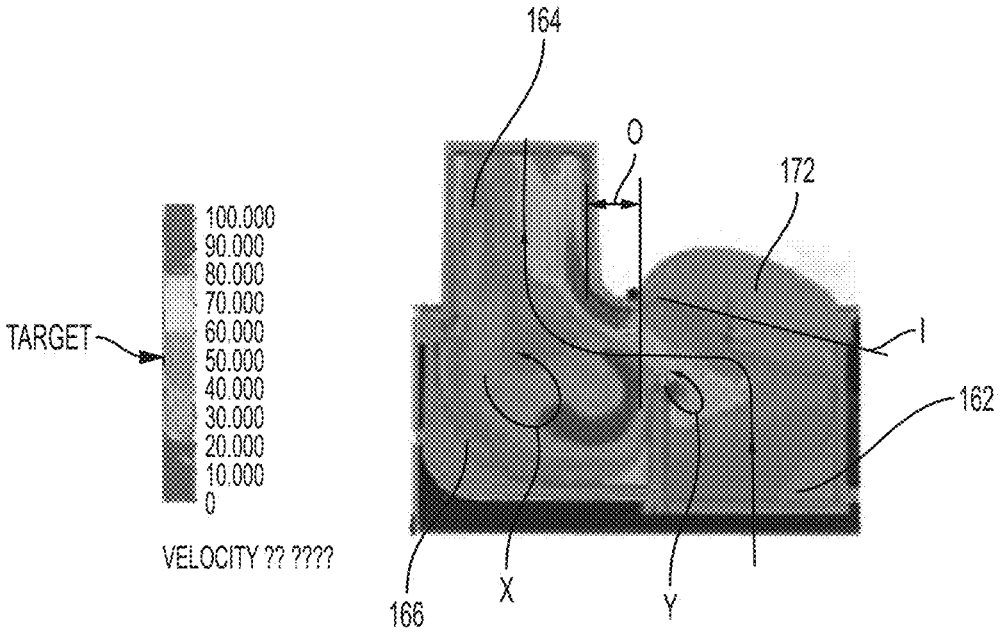
FIG. 9 is a schematic illustrating flow patterns in the reservoir according to some embodiments of the invention.

In some cases, the reservoir 160 is shaped to be generally self-cleaning such that the reservoir 160 clears most waste trapped in the fluid trap portion 166 when the vacuum system starts suctioning waste from the floor to the recovery hose 130. In other words, during operation of the machine, if the vacuum system is disengaged or if the machine is switched off by an operator, waste and particle waste still present in the recovery hose 130 fall back into the fluid trap portion 166. When the machine is started again, the shape of the reservoir 160 can assist in removing the trapped waste from the trap portion and directing the waste toward the outlet passage 164 and the waste recovery tank 120. For instance, the fluid trap portion 166 can have rounded or inclined surfaces 168, 170 (best seen in FIGS. 6 and 9) to form jets or vortices that can direct waste away from the fluid trap portion 166 and into the outlet passage 164 to be carried to the waste recovery tank 120. The inclined portion 170 adapted can additionally direct waste from the inlet passage 162 to flow in a direction generally parallel to an inclination axis "I" and toward the outlet passage 164. Additionally, the rounded or inclined shape of the reservoir 160 can cause waste in the recovery hose 130 to be drawn inside the reservoir 160 with a generally uniform velocity at the inlet passage 162.

In some cases, the inlet passage 162 and the fluid trap portion 166 are formed integrally within the squeegee retainer 144, thereby providing a low-profile waste recovery system that has a compact footprint. The squeegee retainer 144 can be molded into form the desired reservoir 160 shape. Referring back to FIGS. 3 and 6, the reservoir 160 can be provided with a cover 172 removably coupled to the squeegee frame 142. The cover 172 can cover at least a portion of the reservoir 160. The cover 172 can provide access to the fluid trap portion. For instance, if an operator desires removal of trapped waste in the fluid trap portion 166, the operator can remove the cover 172 and clean the reservoir 160. However, in other embodiments, the cover 172 can be integrally formed (e.g., by molding) with the squeegee frame 142. Alternatively, the outlet passage 164 can be integrally formed with the squeegee frame 142 which in turn can house the squeegee retainer 144 with the reservoir 160 formed integrally thereon. The cover 172 can be removably connected to the reservoir 160. In such cases, the top portion of the squeegee frame 142 can be integrally formed with the outlet passage 164, while the bottom portion of the retainer 144 comprises a cavity, which can be closed by the cover 172 to form the reservoir 160.

Figure 8:
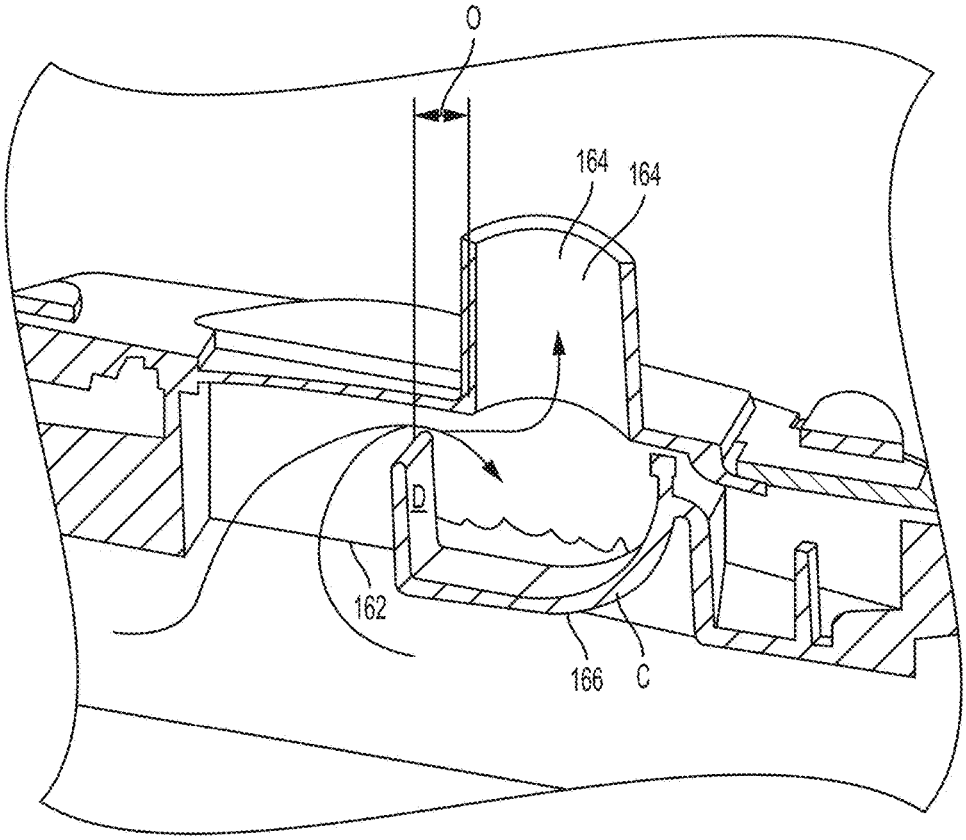
FIG. 8 is a close up view of a sectional view of a reservoir according to some embodiments of the invention.

As best seen in FIGS. 6 and 8, the walls of the inlet and outlet passages 162, 164 are offset from each other by an offset distance "O". In other words, the outlet passage 164 may not have a line of sight in some embodiments such that trapped waste from the outlet passage 164 flow directly into the fluid trap portion 166 without entering the inlet passage 162 when the vacuum system stops suctioning waste from the floor surface.

In operation, an operator can treat a floor surface 10 by spraying or pouring water and/or a cleaning fluid on the surface and engaging one or more cleaning tools (e.g., brushes or pads) to treat the floor surface. The squeegees 146, 148 can direct any solid or fluid waste and funnel them toward the inlet passage 162 of the waste recovery system 150. The vacuum system can be engaged to draw the waste into the waste recovery system 150 and store them in waste recovery tank 120. When the machine 100 is switched off or the vacuum system is disengaged, any remaining residual waste or waste in the system can drip back and be collected by the fluid trap portion 166 of the reservoir 160 until a subsequent engagement of the vacuum system. When the vacuum system is subsequently engaged, the air flow pattern (generated by the vacuum system) inside the fluid suction path 152 can create one or more jets or vortices and by a swirling motion (e.g., shown by arrows "x" and "y" in FIG. 9), direct the waste and waste stored in the fluid trap portion 166 toward the outlet passage 164 and further direct them away to the waste recovery tank 120, thereby "self-cleaning" the fluid trap portion. Alternatively, an operator can also remove the cover of the reservoir 160 and gain access to trapped waste contained therein and remove the waste manually.

Embodiments illustrated herein can have a number of advantages. The reservoir can be integrally formed with the squeegee retainer, thereby reducing the cost of manufacturing and lead times involved in assembling the reservoir to the squeegee assembly and the waste recovery system. Also, the reservoir being integral to the squeegee retainer reduces footprint on the rear portion of the floor surface maintenance machine, and because of its compact size, the waste recovery systems illustrated herein can be incorporated into small and portable floor surface maintenance machines. The fluid trap portion of the reservoir being positioned close to the floor surface can prevent residual waste leaking back to the floor surface when the vacuum system is disengaged.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A waste recovery system for a floor surface maintenance machine comprising:

a squeegee assembly having a squeegee frame having a top edge, and a first squeegee operable to engage a floor surface and connected to the squeegee frame; and a reservoir operatively connected to the squeegee assembly, the reservoir comprising an inlet passage, an outlet passage and a fluid trap portion in fluid communication with the inlet passage and outlet passage, the fluid trap portion having a bottom wall and side walls, the fluid trap portion being adapted to retain backflow waste within the side walls and the bottom wall, the bottom wall of the fluid trap portion being positioned below the top edge of the squeegee frame, such that backflow waste trapped above the fluid trap portion pools within a space formed by the bottom wall and the side walls of the fluid trap portion and is prevented from draining to the floor surface.

2. The waste recovery system of claim 1, wherein the fluid trap portion is generally inline with the outlet passage.

3. The waste recovery system of claim 1, wherein the fluid trap portion has a rounded shape, the rounded shape of the fluid trap portion causing waste to be drawn inside the reservoir with a generally uniform velocity at the inlet passage.

4. The waste recovery system of claim 3, wherein the rounded shape of the fluid trap portion assists in clearing waste trapped in the fluid trap portion when a vacuum system connectable to the waste recovery system starts suctioning waste from the floor surface to the waste recovery system.

5. The waste recovery system of claim 4, wherein walls of the inlet passage and outlet passage are offset from each other by an offset distance such that trapped waste from the outlet passage flow directly into the fluid trap portion without entering the inlet passage when the vacuum system stops suctioning waste from the floor surface.

6. The waste recovery system of claim 1, wherein an inlet of the inlet passage has an inlet passage height sufficient to cause the waste to be drawn into the reservoir with a uniform velocity into the inlet passage.

7. The waste recovery system of claim 6, wherein the inlet passage has a first wall extending to a height equaling an inlet passage height, the outlet passage has a second wall, wherein the fluid trap portion is defined by the first wall of the inlet passage and the second wall of the outlet passage.

8. The waste recovery system of claim 1, further comprising a cover removably coupled to the squeegee frame, the cover adapted to cover at least a portion of the reservoir, wherein the cover is configured for providing access to the fluid trap portion.

9. The waste recovery system of claim 1, further comprising a second squeegee connectable to the squeegee frame.

10. The waste recovery system of claim 9, wherein the second squeegee is placed proximal to a back wall of the squeegee frame wherein the back wall of the squeegee frame is generally located on a rear portion of the floor surface maintenance machine.

11. The waste recovery system of claim 10, wherein the second squeegee is supported by the squeegee frame.

12. The waste recovery system of claim 10 wherein the fluid trap portion has a front wall and a rear wall, the front wall and the rear wall of the fluid trap portion being positioned interior to a space formed by the first squeegee and the second squeegee.

13. The waste recovery system of claim 12, wherein the waste recovery system is operatively coupled to a vacuum system adapted to start and stop suctioning waste from the floor surface, wherein the fluid trap portion is adapted to retain and pool backflow waste when the vacuum system stops suctioning waste from the floor surface.

14. The waste recovery system of claim 13, further comprising a waste recovery tank, a recovery hose fluidly coupled to the waste recovery tank and a fluid suction path extending from the floor surface to the waste recovery tank via the recovery hose, the fluid suction path operably coupled to the vacuum system such that the vacuum system draws waste from the floor surface through the fluid suction path by applying a suction force.

15. The waste recovery system of claim 14, wherein the reservoir is shaped to be generally self-cleaning such that the reservoir substantially clears backflow waste trapped in the fluid trap portion when the vacuum system starts suctioning waste from the floor surface to the waste recovery tank.

16. The waste recovery system of claim 15, wherein:

the inlet passage is positioned proximal to a rear wall of the squeegee frame, the outlet passage is fluidly coupled to the fluid suction path and leading to the waste recovery tank, the first squeegee is positioned near the rear wall of the squeegee frame, and the second squeegee is positioned near a front wall of the squeegee frame, the front wall of the squeegee frame being opposite to the rear wall of the squeegee frame.

17. The waste recovery system of claim 1, wherein the inlet passage is offset from a transverse centerline of the squeegee frame and towards the second squeegee when the machine is moving in a forward direction.

18. The waste recovery system of claim 1, wherein the reservoir includes an inclined portion, the inclined portion adapted to direct waste from the inlet passage to flow in a direction generally parallel to an inclination axis and toward the outlet passage.

19. The waste recovery system of claim 1, wherein the squeegee frame supports the first squeegee.

20. The waste recovery system of claim 19, wherein the bottom wall of the fluid trap portion is below an upper end of the first squeegee.

21. The waste recovery system of claim 1, wherein the side walls of the fluid trap portion are separate from walls of the squeegee frame.

* * * * *